US005338237A

United States Patent [19]

Nealy

[11] Patent Number: 5,338,237

[45] Date of Patent: Aug. 16, 1994

[54] CONNECTOR FOR ATTACHMENT OF A LEASH OR THE LIKE

[76] Inventor: Robert B. Nealy, P.O. Box 3154, San Clemente, Calif. 92672

[21] Appl. No.: 168,455

[22] Filed: Dec. 16, 1993

[51] Int. Cl.[5] ..... A63C 15/06

[52] U.S. Cl. ..... 441/74

[58] Field of Search ..... 441/65, 74, 75; 114/39.2; 410/101-116; 24/109, 115 R, 127, 129 R, 130, 115 G, 115 J

[56] References Cited

U.S. PATENT DOCUMENTS

| | | | |
|---|---|---|---|
| 4,267,615 | 5/1981 | Nealy | 441/75 |
| 5,137,483 | 8/1992 | Nealy | 441/75 |
| 5,154,655 | 10/1992 | Glyden | 441/75 |

*Primary Examiner*—Edwin L. Swinehart
*Attorney, Agent, or Firm*—John E. Vanderburgh

[57] ABSTRACT

A device for attaching a leash to a body board or similar device consisting of male and a female coupler each having an elongated body and an enlarged disk shaped head having a planer inner face for contacting the upper and lower surfaces of the board when the device when the couplers are secured together in the board. The head of the coupler on the upper surface of the board is provided with a leash cord passage which is located along a radius of the coupler between the elongated body and the periphery of the disk shaped head. The leash cord passage opens to the upper and inner faces of the head. A slit is provided in the head to extend radially from the passage to the periphery of the head. The head is sufficiently resilient so that portions of the head adjacent the slit can be bent to open the slit and upon release of the bending force will return to their normal position with the slit closed. The leash is installed by forming a loop around the body of the coupler and passing the body of the cord forming the free ends through the open slit into the cord passage.

9 Claims, 2 Drawing Sheets

CONNECTOR FOR ATTACHMENT OF A LEASH OR THE LIKE

FIELD OF THE INVENTION

This invention relates to devices for connecting lines to an object and more particularly to improved connectors for attaching a leash to a body board or the like.

BACKGROUND OF THE INVENTION

Body boards have become very popular for body surfing or floating where the rider lays or sits on the board. A typical body board comprises a panel of foam plastic which may be somewhat resilient and flexible. It is common practice to utilize a leash which is connected to the leg or ankle of the rider and to the body board. The purpose of the leash is to prevent the rider from losing the body board in the event of a fall. Connectors or "leash anchors" have been developed which are adapted to secure the leash cord to a body board. One such leash anchor is disclosed in the U.S. Pat. No. 4,267,615, Robert B. Nealy, granted May 1981. An improved anchor having a flat head which does not extend above the surfaces of the board is disclosed in U.S. Pat. No. 5,137,483 Robert B. Nealy, granted Aug. 11, 1992.

Leash anchors of the type disclosed in the above mentioned patents, generally comprise a male and a female coupler which extend from opposite surfaces of the board through a through-running passage in the board. The couplers have enlarged heads which clamp against their respective surfaces of the board to secure the connector in place. In some designs, the component of the leash connector on the upper surface of the board is provided with a raised tab having an opening through which the end of the leash cord is extended and looped back on itself to secure the cord to the connector. This design is undesirable, however, because the tab, which extends above the surface of the board, can pose a potential source of injury to the rider.

In the improved connector design disclosed in U.S. Pat. No. 4,267,615, the extended tab is eliminated and a passage is molded into the head of one of the couplers through which the end of the leash cord is passed and brought back on itself to form a loop. Connectors of this design require more complicated tooling and consequently are more difficult and more expensive to manufacture.

The connector design defined in U.S. Pat. No. 35,137,483 provides a center bore in the female coupler and an intersecting opening through the body of the coupler located just beneath the enlarged head portion. In this manner the cord is inserted through the center bore then out through the intersecting opening, passed around the body of the coupler and back up through the intersecting opening and out through the center bore to provide a loop around the body of the coupler to secure the leash thereto. Although somewhat easier to manufacture, this design often times required the use of a rod or a similar tool to feed the leash cord through the center bore and intersecting opening. In addition, it is often necessary to substantially uncouple the connector components in order to secure the leash to the connector.

SUMMARY OF THE INVENTION

The present invention describes an improved flat head connector for the attachment of a leash cord to a body board or the like. It will be understood, however, that the connector described herein is also be useful for attaching cords to other objects, particularly in the case where it is desired that the cord attachment device be essentially flush with the surface of the object to which the cord is being attached. The device of the present invention is easier and less expensive to manufacture than the flat head connectors discussed above. In addition the device of the present invention provides for easy attachment without the need for any tool.

More particularly, the connector of the present invention comprises a male coupler, having a shank and head member, and a female coupler comprising a cylindrical member having a bore open at one end for receiving the shank of the male coupling member. The female coupler is also provided with a head member affixed to the cylindrical member at the end opposite its open end. Both head members define flat outer and inner faces. The shank of the male coupler is preferably threaded for engaging corresponding mating threads, or for tapping threads, in the wall of the bore of the female coupler to secure the couplers together in the board. With the shank of the male coupler threaded down into the bore of the female coupler, the respective head members are clamped tightly against the upper and lower surfaces of the board and are actually drawn inwardly toward each other to depress the material the board under and immediately around the inner faces of the respective head members so that the outer surfaces of the head members are generally flush with the adjacent surface areas of the body board.

In accordance with the invention the coupler to which the leash cord is to be attached is provided with a cord passage through the head member which opens to the upper and lower faces thereof at points located radially inwardly from the periphery of the head member. A radially extending slit in the head member runs from the periphery of the head member to the cord passage to define a first and second section of the head member adjacent the cord passage which can be pried apart to permit insertion of the leash cord from the periphery of the head member into the cord passage.

DETAILED DESCRIPTION OF THE INVENTION

Figure 1:
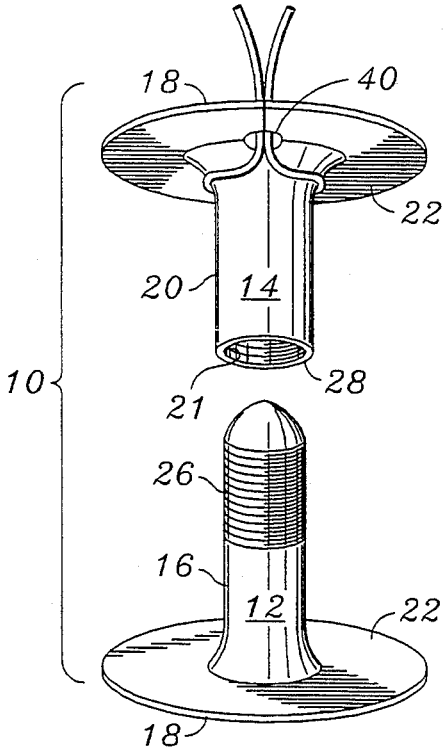
FIG. 1 is a perspective, exploded view of the connector of the present invention.

Referring to FIGS. 1–5, the connector 10 comprises a male coupler 12 and a female coupler 14. The male coupler 12 consists of an elongated body defining a shank 16 having an enlarged, disk shaped head 18 at one end. The female coupler 14 is provided with a cylindrical body 20 having an axially extending bore 21 open at one end for receiving the shank 16 of the male coupler 12 and an enlarged, disk shaped head 18 at the opposite end of the cylindrical body 20. The head 18 of at least one of the couplers is adapted for the connection of a leash cord 30 as will be described below. The head 18 of both the male and female couplers, 12 and 14, define an inner face 22 and an outer face 24 which are essentially planar. As illustrated, the shank 16 is provided with threads 26 which engage corresponding mating threads 28 in the bore 21 of the cylindrical body or, in the alternative, the shank 16 may be self tapping and form its own corresponding threads as it is turned into the bore 21 of the cylindrical body 20 of the female coupler 14. It will be understood, however, that other means for locking the shank 16 in the bore 21 of the cylindrical body 20 may be employed. For example the shank 16 may include a radial projection (not shown) having a free end which is adapted to be received within a recess (not shown) in the bore 21 of the cylindrical body such as disclosed in U.S. Pat. No. 4,267,615. It is preferred, however, that the shank 16 and bore 21 be threaded since this permits the connector 10 to be applied to boards of varying thicknesses.

Figure 2:
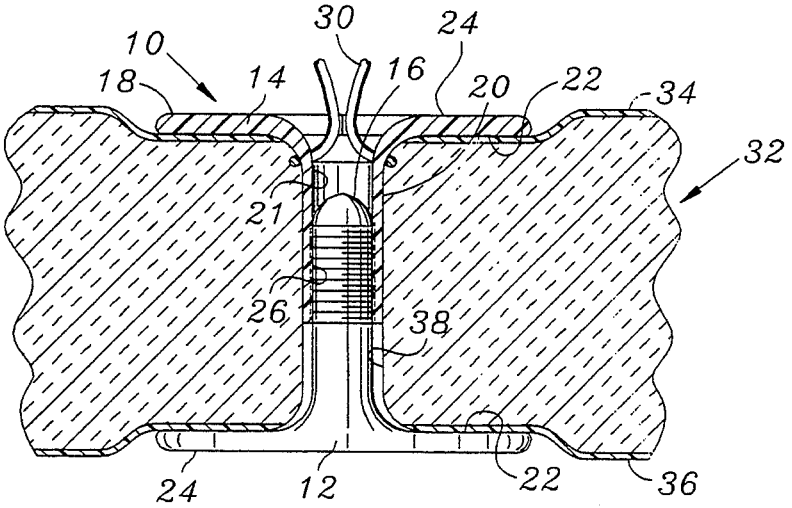
FIG. 2 is a side section of a portion of a body board with the leash connector of FIG. 1 and leash cord attached.

Referring to FIG. 2, the connector 10 is shown installed on a board 32 defining an upper surface 34 and a lower surface 36. A passage 38 extends through the board 32 and opens to the upper surface 34 and the lower surface 36. The shank 16 of the male coupler 12 and the cylindrical body 20 of the female coupler 14 are inserted through opposite passage openings and disposed in the passage 38 with the shank 16 of the male coupler 12 received in the bore 21 of the female coupler 14 so that the inner faces 22 of the male and female coupler heads are drawn against the respective lower surface 36 and upper surface 34 of the board 32. In the embodiment illustrated, the female coupler 14 is positioned on the upper surface 34 of the board 32 and thus is adapted to secure the leash cord 30. However, it will be understood that the male coupler 12 can be utilized on the upper surface 34 of the board 32 and be adapted for connection of the leash cord 30 in accordance with the invention.

Figure 3:
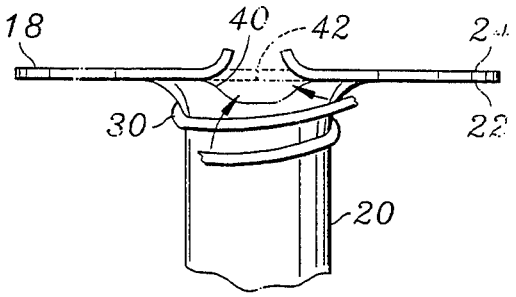
FIG. 3 is a side elevation of the female coupler illustrating sections of the head member pried upwardly to open the slit.
Figure 4:
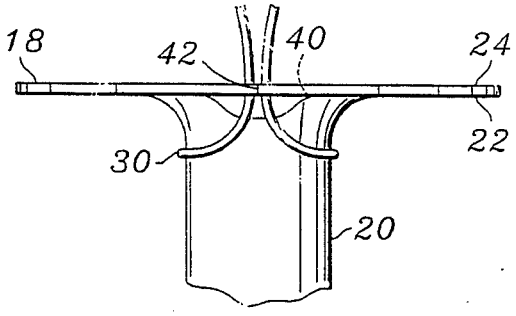
FIG. 4 is a side elevation of the female coupler of FIG. 3 with the sections of the head member in place to close the slit.
Figure 5:
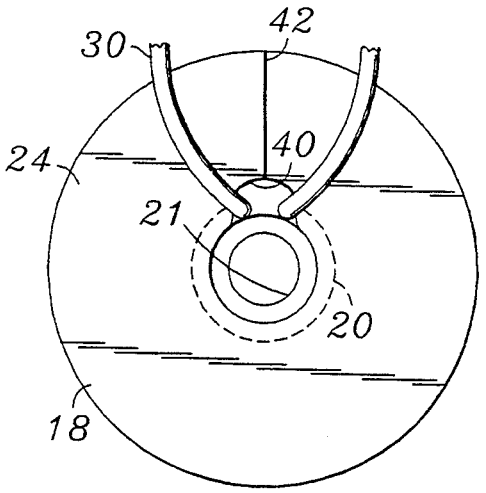
FIG. 5 is a top plan view of the female coupler of FIG. 3.
Figure 7:
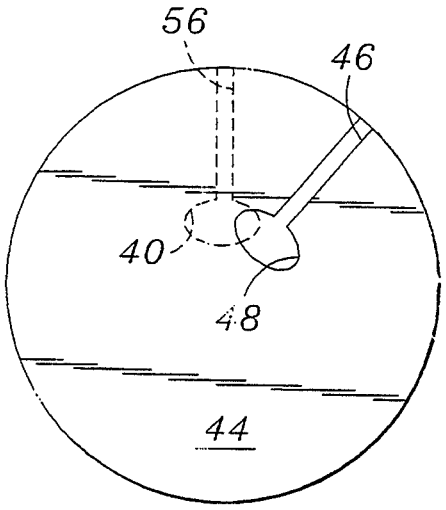
FIG. 7 is a top plan view of the device illustrated in FIG. 6 showing the disk slot out of alignment with the head slot.

Referring to FIGS. 3–5, the female coupler 14 is adapted for connection of the leash cord 30 by the provision of a cord passage 40 which opens to the outer and inner faces, 22 and 24, along a radius of the head 18 between the cylindrical body 20 and the periphery of the head. Preferably the cord passage 40 is located along the radius of the head 18 immediately adjacent to the cylindrical body 20 of the female coupler 14. A slit 42 projects radially from the leash cord passage 40 to the periphery of the head 18. The head 18 is sufficiently resilient so that the edges of the slit 42 can be moved apart, such as by bending adjacent portions of the head to open the slit for insertion of the leash cord 30 from the periphery of the head into the leash cord passage 40. As is conventional in the art, it is preferred that the male and female couplers, be formed of a resilient non-corrosive material, preferably a plastic material such as nylon or polyurethane, which has sufficient rigidity to compress the surfaces of the board 32 when the couplers are drawn together yet is sufficiently resilient to permit the edges of the slit 42 to be moved apart to open the slit for the insertion of the leash cord 30 and to return to the normal position with the slit closed.

Installation of the leash cord 30 in accordance with the present invention is readily accomplished as follows. The leash cord 30 is positioned around the cylindrical body 20 of the female coupler 14 (the coupler on the upper surface 34 of the body board 32 adapted for attachment of the leash in the illustrated embodiment) with the open ends of the cord extending generally away from the cylindrical body, preferably parallel to the slit 42. The female coupler 14 may be unscrewed in order to raise the inner face 22 of the head 18 away from the upper surface 34 of the board 32 to provide space for the leash cord 30 between the inner face of the head and the upper surface 34 of the board 32. However, this is normally unnecessary as the resilient nature of the board 30 permits the leash cord 30 to be worked between the inner face 22 and the upper surface 34. The facing edges of the slit 42 are moved away from each other by applying bending force to portions of the head 18 adjacent the slit. The open slit provides access to the leash cord passage 40 for the leash cord 30 comprising the paired ends of the loop. The force is then released and the resilient nature of the head 18 allows the bent portions to return to their normal position to close the slit 42. In this manner it can be seen that the cord 30 is now looped securely around the body 20 of the female coupler 14 with the free ends extending upwardly through the leash cord passage 40. Due to its compressible nature, the upper and lower surfaces, 34 and 36, of the board 32 are depressed by the coupler heads 18 in the area surrounding the heads as the couplers 12 and 14 are drawn together so that the outer faces 24 of the heads are at or below the surface of the board 32. The loop of the cord 30 is forced down into the connector passage 38 of the board 32 and does not prevent the outer surface of the head 18 of the coupler from reaching a position flush with the outer surface of the board.

In the preferred embodiment of the invention, the bore 21 of the female coupler 14 also opens to the outer face 24 of the head 18. The cord passage 40 is immediately tangent to the bore 21 so that the opening of the leash cord passage 40 in the outer face 24 of the head 18 and the opening of the bore 21 on the outer face 24 of the head 18 are merged together. The edges of the leash cord opening and the opening of the bore 21 are beveled to avoid presenting a sharp surface to the leash cord 30. It will be understood, however, that it is not necessary to merge the opening of the leash cord passage 40 and the bore 21 and that the leash cord passage can be separate and distinct. Such would be the case if the male coupler 12 were adapted for the attachment of the leash cord 30 or if the female coupler 14 was provided with a blind bore.

Figure 6:
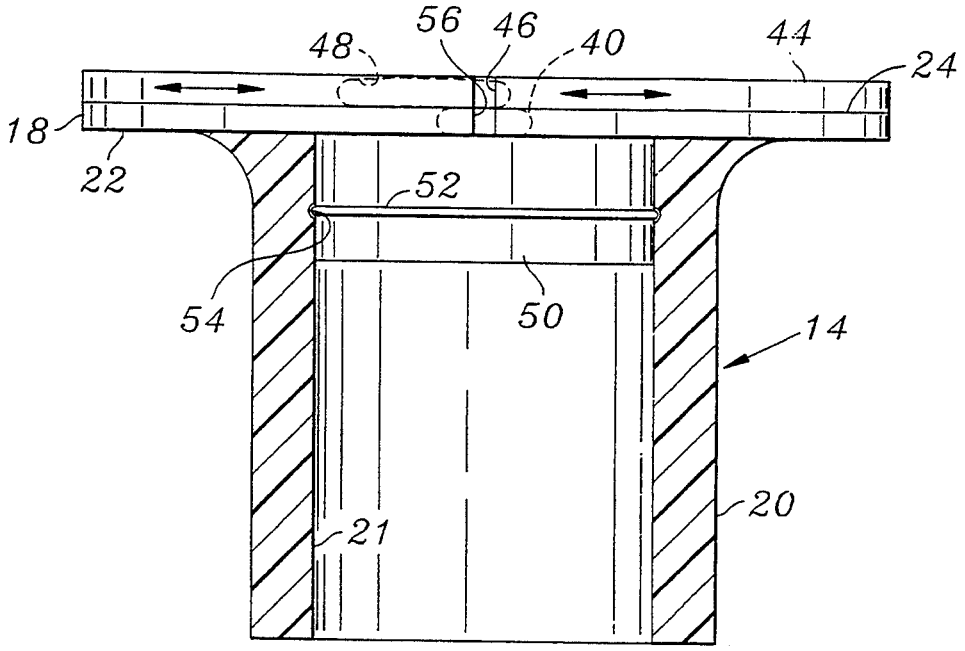
FIG. 6 is a side view, partially in section, of another embodiment of the invention showing a rotatable disk carrying a slot in alignment with a slot in the coupler head.

Referring to FIGS. 5 and 6, there is shown another embodiment of the invention wherein a rotatable disk 44, carrying a slot 46 opening to the periphery of the rotatable disk at its radially extending end and having an enlargement 48 at its inner end, is mounted over the outer face 24 of the coupler head 18. A downwardly extending cylindrical member 50 formed on the undersurface of the rotatable disk 44 is dimensioned to fit snugly but movably within the bore 21 of the cylindrical body 20 of the coupler 14. A ring 52 formed about the circumference of the member 50 is received in a groove 54 formed in the bore 21 for rotatably securing the disk. The head 18 of the coupler 14 is also provided with a slot 56 which opens to the periphery of the head at one end and which communicates with the cord passage 40 at the opposite end.

The slot 46 of the rotatable disk 44 is aligned with the slot 56 and cord passage 40 of the coupler 14 to allow insertion of the free ends of a leash cord into the cord passage after the cord is looped around the body 20 of the coupler 14 in the manner described for securing the leash cord to the coupler. Rotating the rotatable disk 44 moves the slots, 46 and 56, out of alignment to prevent the leash cord from leaving the cord passage 40, although the enlargement at the inner end of the slot 46 in the rotatable disk is sufficiently large so that a portion remains aligned with the cord passage for extension of the free ends of the leash cord.

From the foregoing it will be seen that a leash cord can be attached quickly and conveniently to the connector 10 of the present invention without the necessity of the use of additional tools or without completely disassembling the connector 10 and removing it from the board.

As will be understood by those skilled in the art, various arrangements other than those described in detail in the specification will occur to those persons skilled in the art, which arrangements lie within the spirit and scope of the invention. It is therefore the be understood that the invention is to be limited only by the claims appended thereto.

Having described the invention, I claim:

1. In a connector for attaching a leash to a body board having an upper and a lower surface and a passage extending through said board and opening on said upper and lower surfaces, said connector comprising a male coupler and a female coupler, said couplers including an elongated body and an enlarged disk shaped head at one end thereof, said female coupler further including an axially extending bore in said body opening at one end for receiving at least a portion of said body of male coupler for securing said couplers together, the enlarged disk shaped heads of said male and said female couplers defining an essentially planer outer and inner face, said body of said male coupler and said female coupler being inserted through opposite openings of said passage and received therein with said body of said male coupler secured in said bore of said female coupler to clamp said board between said inner surfaces of the male and female coupler heads thereby to secure said connector to said board:

the improvement comprising a leash cord passage extending through said head of one of said couplers to open at the outer and inner faces thereof, said passage being located along a radius of said head between its periphery and said body of said coupler, a radially extending slit from said leash cord passage to the periphery of said head, the area of said head adjacent said slit being resilient to allow said slit to be opened for the insertion of said leash cord and to be returned to the normally closed position, said leash being looped around said coupler body and extending upwardly through said leash cord passage thereby attaching said leash to said board when said device is secured in said board.

2. The device of claim 1 wherein the bore of said female coupler is open to the outer surface of the head and said cord passage is immediately tangent to the bore.

3. The device of claim 1 wherein the bore of said female coupler and said cord passage are radially spaced apart.

4. The device of claim 1 wherein the edges of said leash cord passage along said upper face of said head are beveled.

5. In the combination of a body board having an upper and a lower surface and a passage extending through said board and opening on said upper and lower surfaces, a connector for attaching a leash to said body board and a leash attached thereto, said connector comprising a male coupler and a female coupler, said couplers including an elongated body and an enlarged disk shaped head at one end thereof, said female coupler further including an axially extending bore in said body opening at one end for receiving at least a portion of said body of male coupler for securing said couplers together, the enlarged disk shaped heads of said male and said female couplers defining an essentially planer outer and inner face, said body of said male coupler and said female coupler being inserted through opposite openings of said passage and received therein with said body of said male coupler secured in said bore of said female coupler to clamp said board between said inner surfaces of the male and female coupler heads thereby to secure said connector to said board:

the improvement comprising a leash cord passage extending through said head of one of said couplers to open at the outer and inner faces thereof, said passage being located along a radius of said head between its periphery and said body of said coupler, a radially extending slit from said leash cord passage to the periphery of said head, the area of said head adjacent said slit being resilient to allow said slit to be opened for the insertion of said leash cord and to be returned to the normally closed position, said leash being looped around said coupler body and extending upwardly through said leash cord passage thereby attaching said leash to said board when said device is secured in said board.

6. The device of claim 5 wherein the bore of said female coupler is open to the outer surface of the head and said cord passage is immediately tangent to the bore.

7. The device of claim 5 wherein the bore of said female coupler and said cord passage are radially spaced apart.

8. The device of claim 5 wherein the edges of said leash cord passage along said upper face of said head are beveled.

9. In a connector for attaching a leash to a body board having an upper and a lower surface and a passage extending through said board and opening on said upper and lower surfaces, said connector comprising a male coupler and a female coupler, said couplers including an elongated body and an enlarged disk shaped head at one end thereof, said female coupler further including an axially extending bore in said body opening at one end for receiving at least a portion of said body of male coupler for securing said couplers together, the enlarged disk shaped heads of said male and said female couplers defining an essentially planer outer and inner face, said body of said male coupler and said female coupler being inserted through opposite openings of said passage and received therein with said body of said male coupler secured in said bore of said female coupler to clamp said board between said inner surfaces of the male and female coupler heads thereby to secure said connector to said board:

the improvement comprising a leash cord passage extending through said head of one of said couplers to open at the outer and inner faces thereof, said passage being located along a radius of said head between its periphery and said body of said coupler, a radially extending slot from said leash cord passage to the periphery of said head, a rotatable disk mounted over the outer face of said head, said rotatable disk having a radially inwardly extending slot from the periphery of said rotatable disk, said slot defining an enlarged inner end located in said rotatable disk a distance equal to the distance from said cord passage to the periphery of said head, said rotatable disk being movable between a first position with its slot overlying and aligned with said slot and said cord passage in said coupler head and a second position with its slot out of alignment with said slot in said coupler head.

* * * * *